US008920230B2

(12) United States Patent
Siewert et al.

(10) Patent No.: US 8,920,230 B2
(45) Date of Patent: Dec. 30, 2014

(54) GAME METHOD AND APPARATUS

(76) Inventors: Neil Siewert, Bowden (AU); Timothy Gard, Mitcham (AU)

( * ) Notice: Subject to any disclaimer, the term of this patent is extended or adjusted under 35 U.S.C. 154(b) by 0 days.

(21) Appl. No.: 13/507,060

(22) Filed: Jun. 1, 2012

(65) Prior Publication Data

US 2012/0315974 A1 Dec. 13, 2012

Related U.S. Application Data

(63) Continuation of application No. 12/565,043, filed on Sep. 23, 2009, now abandoned, which is a continuation of application No. 11/043,891, filed on Jan. 26, 2005, now abandoned, which is a continuation of application No. 10/031,837, filed as application No. PCT/AU00/00884 on Jul. 24, 2000, now abandoned.

(30) Foreign Application Priority Data

Jul. 23, 1999 (AU) ..... PQ1813
Dec. 3, 1999 (AU) ..... PQ4445

(51) Int. Cl.
*A63F 5/00* (2006.01)
*A63F 3/04* (2006.01)

(52) U.S. Cl.
CPC ..... *A63F 5/00* (2013.01); *A63F 2003/0439* (2013.01)
USPC ..... 463/17

(58) Field of Classification Search
CPC ..... A63F 3/00028; A63F 3/00031; A63F 3/00041; A63F 3/00044; A63F 3/00047; A63F 3/00005; A63F 3/00053; A63F 3/00063; A63F 3/00069; A63F 3/00072; A63F 3/00075; A63F 3/00082; A63F 3/00085; A63F 3/00088; A63F 3/00094; A63F 3/00097; A63F 3/001; A63F 3/00119; A63F 3/00138; A63F 3/00145; A63F 3/00148; A63F 3/00151; A63F 3/00154; A63F 3/00643; A63F 3/00694; A63F 3/0434; A63F 3/0449; A63F 3/04; A63F 3/0457; A63F 3/0478; A63F 3/0494; A63F 3/0497; A63F 7/06; A63F 7/0604; A63F 7/0608; A63F 7/0612; A63F 7/0616; A63F 7/062; A63F 7/0624; A63F 7/0628; A63F 7/0632; A63F 7/0636; A63F 7/064; A63F 7/0644; A63F 7/0648; A63F 7/0652; A63F 7/0656; A63F 7/0664; A63F 9/14; A63F 9/143; A63F 2003/00009; A63F 2003/00012; A63F 2003/00015; A63F 2003/00018; A63F 2003/00022; A63F 2003/00025; A63F 2003/00034; A63F 2003/00037; A63F 2003/00066; A63F 2003/00078; A63F 2003/00996; A63F 2003/0436; A63F 2003/0439; A63F 2003/0442; A63F 2003/0444; A63F 2003/0447; A63F 2009/146; A63F 2011/0097; A63F 5/00; G07F 17/3288
USPC ..... 463/17–19, 25–28, 40–42; 273/269, 273/244, 244.1, 244.2, 245, 246, 247, 277, 273/296
See application file for complete search history.

(56) References Cited

U.S. PATENT DOCUMENTS 5,782,470 A * 7/1998 Langan ..... 273/139
5,853,327 A * 12/1998 Gilboa ..... 463/39

OTHER PUBLICATIONS

"Scarne's Complete Guide to Gambling," by John Scarne, 1661, Simon & Schuster, New York, N.Y., chapters on horse racing, sports events, numbers game, and roulette.*
Alice Corp. 101 memo issued to examiners.*
*Alice Corp.* vs. *CLS Bank*, U.S. Supreme Court decision.*

* cited by examiner

*Primary Examiner* — David L Lewis
*Assistant Examiner* — Matthew D Hoel

(57) ABSTRACT

Game playing apparatus described displaying in an image-space (12) an aspect of a playing environment and overlays on the image-space zones (14,16) that have relevance to playing environment. Event/s occurs in the playing environment in a delineated zone/s. Game participant is able to mark (18) with a marker a zone or zones before the event in anticipation of a reward if they mark the zone in which the event occurs. Their reward may be set by predetermined odds or a portion of pooled wagers. The playing environment may be a live event, live sporting event, or pre-planned scenario. The image-space (12) may only be a representation of the playing environment or aspect of the playing environment. The game participant may wager remotely of game apparatus with remote control devices allowing them to mark and wager. The remote control device may be built into other devices like mobile telephones etc.

20 Claims, 5 Drawing Sheets

GAME METHOD AND APPARATUS

CROSS REFERENCE TO RELATED APPLICATIONS

The present application is a Continuation of application Ser. No. 12/565,043 filed Sep. 23, 2009, now abandoned which is in turn, a Continuation of Application Serial No. 11/043,891, filed Jan. 26, 2005, now abandoned, which is in turn, a Continuation of application Ser. No. 10/031,837, filed May 28, 2002, now abandoned, which is in turn, a National Stage Application claiming the priority of PCT Application No. PCT/AU00/00884 filed Jul. 24, 2000, which in turn, claims priority from Australian Application No. PQ1813 filed Jul. 23, 1999 and Australian Application No. PQ4445, filed Dec. 3, 1999. Applicants claim the benefits of 35 U.S.C.§120 as to the prior U.S. Non-provisional applications and the said PCT application, and priority under 35 U.S.C.§119 as to the said Australian applications, and the entire disclosures of all applications are incorporated herein by reference in their entireties.

This invention relates to a method and apparatus for playing a game, in particular a game having an element of chance and an element of skill.

BACKGROUND

Chance plays a large part in most board games. The toss/throw of a dice is the most common means of producing an event with a random outcome. Obviously, in the case of a dice, it is the determination of which side lies uppermost once the dice comes to rest (visible to all game participants) which determines the number, symbol or colour as the random outcome. Such a device produces an ideal probability that the result will be one of six outcomes. Other random event apparatus include the toss of one or more discs (coins), the fall of a ball into one of 37 (European) or 38 (American) spaces located on a horizontally spinning wheel, etc.

A large and important part of most board games is the playing space, typically a planar surface marked with a route over which a player's token, marker or piece is moved. Each possible location of a token on the planar surface will have a predetermined value or significance. The shape of most planar playing surfaces is square or rectangular, but a variety of shapes can be used. There can also be various routes over which the playing token can be moved. Tokens are typically moved in a predetermined direction in accordance with the result of the random event.

There exists a small number of games which incorporate three-dimensional shapes and a three dimensional route into the playing space. A classic example of a three-dimensional game is Mousetrap™ where it is an aim of the game to build an intricate framework which, at a predetermined time in the game, comes into play such that a trap is lowered onto a playing piece of a competing player located in the vicinity of the trap.

Typically however, the playing routes of most games are permanently marked and all possible routes are predetermined.

Skill in most games is created by requiring the participants to risk a penalty for the failure to appropriately respond to an event or wrongly predict an event or to fail to have the knowledge of a particular fact, and in the alternative to be rewarded for a correct response, prediction or fact.

A number of games can be played so that the participants can wager their own money so that the penalty or reward is purely monetary rather than the thrill of being better than other participants at accumulating whatever is the currency of the game (ie points, tokens, play money, etc.).

It is an aim of the method and apparatus described herein to provide an entertaining game of chance which also requires skill, on a playing surface which is capable of changing with each occurrence of a random event and which may be played for monetary or other reward.

BRIEF DESCRIPTION OF THE INVENTION

In a broad aspect of the invention a game playing apparatus comprises, an environment either real or created which itself is not a game of chance in which an event occurs, the apparatus comprising:

a means to delineate zones with delineation indicators wherein said zones correspond to zones in said real or created environment or in a visual representation thereof such that said event may occur within or under a zone or on a delineation indicator and thus associated with one or more zones to thereby create a game of chance that associates an event outcome with a zone or zones; when a plurality of markers, each marker having a predetermined value measured in a predetermined number of value units, for a game participant to associate with said one or more delineated zones; and an electronic display means to present the zone that said event becomes associated with and/or a visual representation of said real or created environment where said event occurs within or under a zone or on a delineation indicator, such that a game participant is rewarded by the addition of a marker/s of value or value to the one or more markers which a participant has associated with the zone that the event becomes associated with, and a game participant is penalized by the removal of the said one or more markers or the removal of value from the said one or more markers that a participant did not associate with a zone that the event becomes associated with.

In a further aspect of the game playing apparatus, the reward is made in accordance with odds related to the event occurring in a zone.

In a yet further aspect of the game playing apparatus, the value of the markers that are risked by the one or more participants are pooled and a reward to a participant comprises a predetermined proportion of the pooled value.

In another aspect of the invention a method of game play consists of the steps:

a) creating or observing an environment which itself is not a game of chance in which an event occurs;

b) delineating with delineation indicators a plurality of zones wherein said zones correspond to zones in said real or created environment or a visual representation thereof such that said event may occur within or under a zone or on a delineation indicator and thus associated with one or more zones to thereby create a game of chance that associates an event outcome with a zone or zones;

c) displaying to one or more participants the zone that said event becomes associated with and/or a visual representation thereof where said event occurs within or under a zone or on a delineation indicator and thus with one or more zones;

d) a game participant associating with one or more of said delineated zones in said display a marker or markers having a predetermined value measured in a predetermined number of value units;

e) an event outcome being associated with a zone; such that
- a game participant is rewarded by the addition of a marker/s or value to the one or more markers that are associated with the zone that the event becomes associated with; and
- a game participant being penalized by the removal of the said one or more markers or the removal of value from the one or more markers not associated with the zone that the event becomes associated with.

Specific embodiments of the invention will now be described in some further detail with reference to and as illustrated in the accompanying figures. These embodiments are illustrative, and not meant to be restrictive of the scope of the invention. Suggestions and description of other embodiments may be included but they may not be illustrated in the accompanying figures or alternatively features of the invention may be shown in the figures but not described in the specification.

DETAILED DESCRIPTION OF EMBODIMENTS OF THE INVENTION

Figure 1:
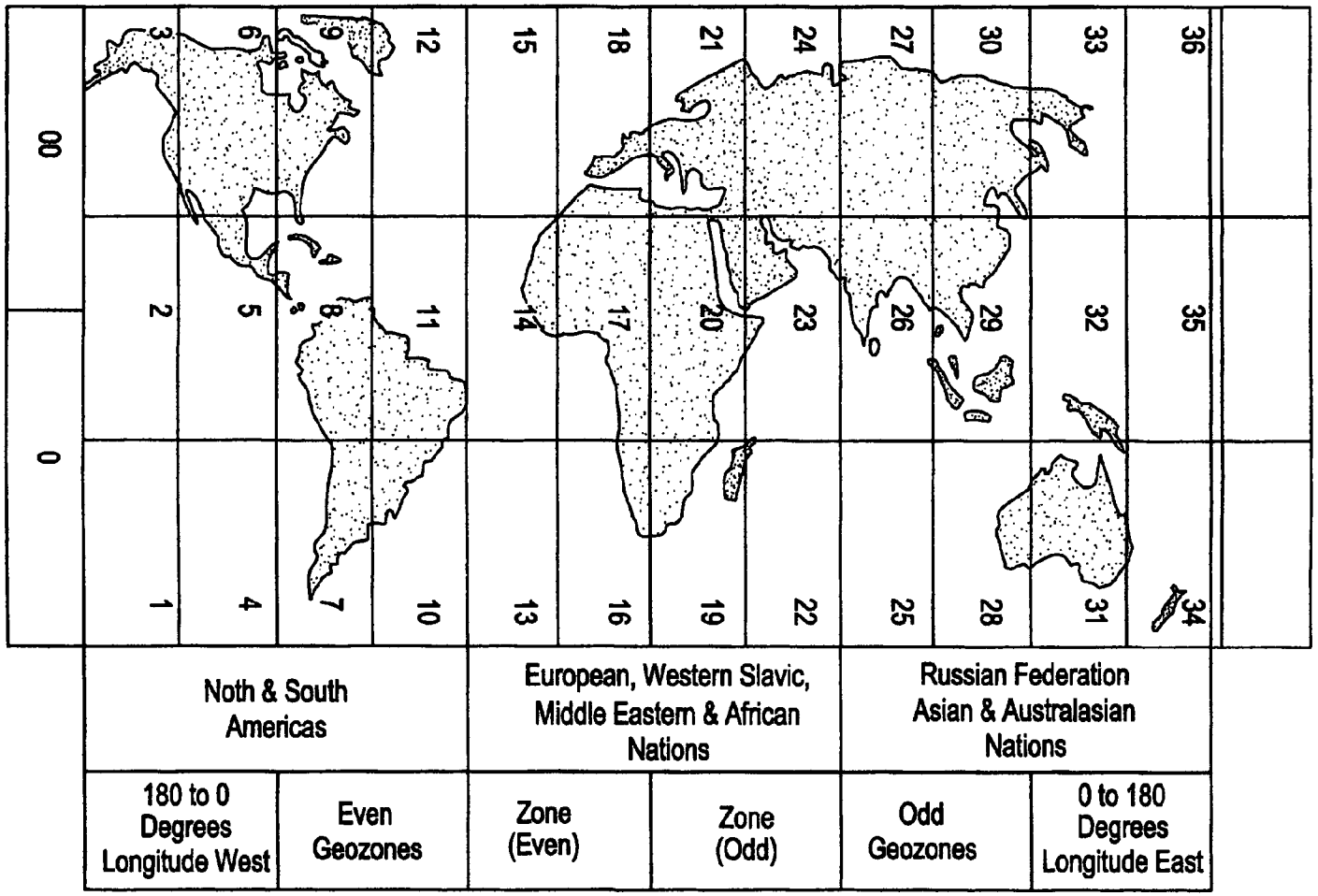
FIG. 1 depicts screen 1 of a preferred two-dimensional image space.

The best way to describe the invention is to describe the playing of the game using various environments and apparatus.

It must be understood though, that the examples provided are but a sample of an infinite variety of examples. Underlying the game examples lies a framework comprising a method and apparatus for playing the game that uses one of a variety of image spaces. The various image spaces change as they are determined by the game creator for the playing of a variety of scenarios on various apparatus suitable for the task. Alternatively, in other embodiments, the various image spaces are provided by live events such as sporting contests and the game method allows for various game playing modes, one of which may involve interactive betting. In the example, depicted in FIG. 1, the variable image space is two-dimensional and comprises a planar image. This image could be a picture on a playing board or a computer monitor or some other type of display device such as a projector or even an object having an image thereon.

In a further example, the image space is displayed separately from the playing environment. While an actual football contest is being shown on say a large screen monitor, a representation of one aspect of the football contest is provided on a separate apparatus, for example a table top could have the shape of the football field paying surface marked upon it. Over that shape and around it if required there can be delineated a plurality of zones.

In one method of play, a game participant may place a marker on or over a portion of two or more zones into which the game participant thinks the event will occur in at some future time during the progress of the football contest. The correlation between the zones on the table and the actual football playing surface is provided in a number of possible ways. For example, an aerial view of the playing field may allow the game participants to see the field and the zones may then be superimposed over the live aerial view. Alternatively, there could be sensors built into the playing field which are capable of detecting the predetermined event and displaying to the game participants what the event was if it occurred in a particular zone.

The facility of simultaneous display of both the playing environment and the image space can be achieved using split screen or multiple screen arrangements.

The type of event used to play the game is of infinite variety and could range from everyday occurrences to artistic endeavour and to the most popular sporting events.

It is also possible that game participants are not able for technical reasons to view the actual sporting contest. However, if the sensor arrangement described earlier is available and still functioning, it will be possible for the wagering aspect of the game to continue. The result of the event will be reported to the game participants and pay-outs made accordingly. Subsequent events could also be reported all without the actual live event being shown to the game participants. However, this arrangement dearly requires the game participants to have some trust in the game operators to be reporting the actual event outcomes.

The image space can also be three-dimensional and could comprise a multi-level game surface created out of cardboard or adapted to a spherical object or it may comprise a three-dimensional image displayed on a computer monitor.

The game requires that a plurality of zones be delineated in or arranged over the image space and that an event occurs within or over a zone. The aim of the game for the participants is to identify before the event, whether the out come of the event will be within a particular zone or that is in a group of two or more zones chosen by the participant before the event.

The event could be the operation of a random number generator and the event outcome would be the number generated. In that example, if the number is generated from a predetermined range then the probability of the event outcome is known. There is no lack of predicability about the likelihood of an event occurring there is however, no predicability as to which outcome will occur.

The event could be an incident that occurs during the normal play of a live sporting event such as the kicking of a football into a predetermined area of the playing field. To all intents and purposes, such an event has a likelihood of occurring and clearly there is no certainty that it will occur. In this example, it is possible for odds of that outcome occurring and the event is not random but is influenced by innumerable factors some of which the odd setting process are based. There will of course be unpredictable outcomes and that is what makes the game interesting for the game participant. Conversely, unpredictable outcomes are risky for the operator of the game as the odds that have been set will provide a return to the game participant regardless of the unpredictable result.

In FIG. 1, the image space is a pictorial representation of the continental land masses on the surface of the Earth arranged within a rectangular boundary on a planar surface. This image can be provided on for example a computer monitor.

Superimposed over or associated in some other way with the image is a plurality of zones. In this example, the image is divided into 36 zones. The zones are shown as having equal area but need not be so, since there is only an association of a zone with the landmasses depicted within them.

In this embodiment, the term superimposed is an appropriate description of how those zones may be displayed. Since the image used is a two-dimensional map of the world and it is convenient to split the rectangular two-dimensional area encompassing the playing surface into 36 zones. The borders of the zones are laid over the map in a grid-like representation.

However, it is possible in other forms of the game for the zones to be depicted on a monitor screen as an overlay and/or physically marked on the playing surface forming the image space. Further, it is possible for the zones to be delineated by sensors built into the playing area such as in the case when the image space is a live sporting event. The event may be the serving of a tennis ball and the outcome is determined by where the ball may land outside of the tennis court. Sensors delineating the one or more zones external of the marked tennis court-playing surface are located to determine the outcome of an event capable of being detected by those sensors in an accurate manner. The game participants who have an interest in the outcome of the event can then be assured that the outcome result has been properly determined. The images provided to the external participants may well superimpose zones boundaries over the sensor boundaries to assist those game participants but in this example, arrangement of the zone boundaries are unseen by the tennis playing participants. Or the image space provided to the game participants is merely a representation of the playing environment upon which they place their markers or designate in some fashion the zone they place their wager on.

An arrangement where zones are not apparent to the event participant ensures that there is less likelihood of the event participants being influenced or influencing the event outcome. Indeed, such arrangements may be randomly imposed on the live event further ensuring that there is minimal likelihood that the game participants can influence the event outcome.

It is also possible for the zones to be separate from each other, unconnected and unrelated physically to each other. As long as stated previously in the playing-board embodiment, there is an equal chance of the outcome occurring in any one of the zones, the zones do not need a physical relationship to each other. However, in other embodiments, as long as it is possible to allocate odds to the likelihood of the outcome being in or associated with a particular zone, the zones need not be physically related to each other.

In addition to the 36 zones superimposed over the image (primary zones), there are varieties of other zones that may have some relevance to the 36 zones.

In the playing-board-related example, these additional zones (secondary zones) are located adjacent to the 36 zones. The secondary zones are arranged so that their relevance to the 36 zones is spatial as well as being relevant, at the discretion of the game scenario creator, to the context of the image.

For convenience the 36 zones are numbered 1 to 36 and as such it is possible to identify at least two additional zones as being odd zones and even zones as depicted in FIG. 1.

It is also possible to represent the primary zones in any 36 identifiably different ways. For example, each zone might be associated with a fictional or real character. The relevance of the character to the zone, the image space and the random event is up to the game creator. The event could be represented by a wheel that displays the faces of each character, thus upon the ceasing of the rotation of the wheel with a particular character located under a pointer the associated zone is also determined.

It is also possible to relate the layout of the zones in accordance with the image, which in this example comprises the continents on the surface of the Earth. Thus, at least two zones could be related to 0° to 180° longitude east and 180° to 0° longitude west, which effectively represents the numbered zones 1 to 18 and 19 to 36 respectively.

It is also possible to colour the zones, which can then be displayed, by colouring the grid appropriately. For example, each of the zones may be either red or black. If two equally representative additional zones are to be used then, 18 of the zones can be red and 18 of the zones can be black.

It is also possible to relate the first 12 zones with the continents displayed as depicted in FIG. 1. The various groupings of zones can be, the North and South Americas associated with zones 1 to 12, the European, Western Slavic, Middle Eastern and African nations associated with zones 13 to 24, and the Russian Federation, Asian and Australasian nations associated with zones 25 to 36.

Clearly, some licence can be taken with descriptions of zones and the geographic accuracy of the depiction. It would be advantageous to provide factual representations and associations so that this aspect of the game can be an educative aspect of the game as well as being an entertaining one.

Furthermore, it is possible to add additional possible events in the form of additional primary zones not related to the image space. In this example, it is possible to add non-events for the purpose of the theme of the game such as those depicted by the "0" or ("0" and "00") zones. Thus the possible event becomes one out of 37 or 38 possibilities. These additional events could potentially disadvantage or advantage participants. If participants do not place their pieces on those events they will be disadvantaged, or in the case where they do place pieces on those zones, there may be a benefit. For example, when the event is "0" or "00" an appropriate reward is provided to the participant who chooses to play one or both of those zones. Furthermore, the event could result in all participants being penalised, if this event occurs and they have not preselected or marked one or more of those zones.

A resemblance between the number and types of zones will be seen with regard to the game of Roulette, but that is merely for convenience and it will be appreciated that alternative arrangements can exist.

It is clearly possible to have less or greater numbers of zones either primary 36 or 37 or 38 and/or secondary, and for the make-up of the secondary zones to be dependent on other features of the primary zones or the playing space used.

It is also possible to vary, even during a game, the shape of the playing space, so that in one embodiment, the playing space is rectangular within a planar playing space and then change it to a circle within a planar playing space.

It is further also possible to arrange the game theme to incorporate multiple event outcomes so that for any one image space theme there will be two or more zones associated with the event outcomes.

In a further embodiment of the display of the zones, the primary zones are arranged not unlike a pie chart with there being a slice for each zone including "0" and "00" events. In essence, there is a primary zone for each possible event. Furthermore, secondary zones could be arranged about the periphery of the circle containing the primary zones.

If the game were played using an electronically controlled display monitor having a planar surface, the playing space could be infinitely variable. The type of playing space depicted is limited only by the imagination of the game scenario creator. The image space can be realisable in two or three dimensions even on a planar screen (as pictorially represented in FIG. 4 in two dimensions only). It may also be possible to create an electronically controlled three-dimensional playing space (eg a three-dimensional representation of a globe).

Furthermore, it is possible to use moving images rather than static images within each zone, but done, to maintain the relevance of each zone to the theme of the game. For example, in a sports related game, a zone may depict a moving picture of a particular player. In a geographically related game, the zone may be associated with a montage of a significant geographic location such as a national park or statues, etcetera.

Figure 6:
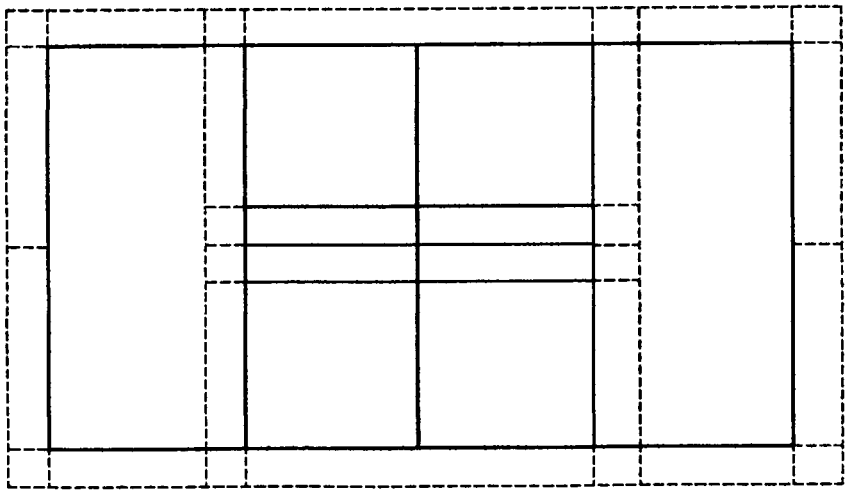
FIG. 6 depicts an image of a tennis court depicting the buried ball bounce location sensors.

In one embodiment, it is possible for the display of zones to be superimposed over and or delineated for a live television event such as a sporting contest. For example, as described briefly before, a game of tennis could comprise the background image and a superimposed zone marking would delineate, for example, a plurality of zones into which a ball may land during play. Refer to FIG. 6. In one particular arrangement, zones may be arranged about the periphery of the serving boundary. The anticipation being that if the tennis player serving the ball is to fault, the ball will land in one of the rectangular zones about the periphery of the court.

Herein, the event occurs in real time, as part of the normal play of a sporting event. Either human or electronic means are used to predetermine a possibility of the event result being the fall of the served ball into one of the rectangular zones and for a game that allows wagering the setting of odds associated with the event outcome occurring in a zone or zones.

Furthermore, it is conceivable for the event to be pictorially represented rather than being actually displayed. Such that if the device upon which the game was represented was a mobile phone screen the lack of space and restricted image formats would necessitate a simplification of the event image as well as clear representations of the plurality of zones.

For example, in a game played on the restricted screen of a mobile phone a game of tennis may only be displayed using a grid to represent the relevant zones and a circle to show the path and eventual landing point on a zone. Odds and the like can be identified with alphanumerics or by recognised symbols, colours, etc. Clearly, the data reception rate of a mobile phone in today's technology is relatively low but if that is a limiting factor, the representation can be sent in various ways. For example, predetermined codes can be associated with the zones and odds can be stored for display upon the receipt of that code at the telephone. Such an arrangement avoids a complete download of odds and only the outcomes need be transmitted to allow mobile phone delivery of the game method.

The mobile phone user may place wagers on outcomes using the mobile phone keypad. The mobile user can also use a cursor controllable on the screen of the telephone to place a marker on a zone. They can then associate with that marker value to be wagered. The value indicated can then be exchanged between a predetermined phone betting account or to and from a stored value card insertable into the phone. The transfer needs to be under taken at that time since the wager will not have effect otherwise. Security of message exchange is expected and provided. As the transmission and reception rate of data to and from mobile telephones improve with new technological advances, the game play experience can be improved and the visual aspects of the game can be enhanced.

Clearly, the mobile phone example is another embodiment of the way in which the game method of this invention can be delivered to participants wishing to place wagers on the outcome of a designated event. However, the game need not involve betting, which is illegal in some places. In those places, it will be possible to accumulate points having no redeemable value purely for the thrill and pleasure of participating.

It will be appreciated that many types of display device can be adapted for displaying a representation of the game method. Some examples include portable personal computers; watches/watch phones/watch radios; large screen televisions viewable by multiple persons, etc.

Interaction with the display devices is necessary and when the term marker is used in this specification, it can be understood to refer to a token of predetermined value which can be represented in both the physical form (chip/marker) or a virtual form (eg, a marker, cursor, digital representation of a token, zone illumination, digital representation associated with the user's digital certificate of identity, etc.). The term marker can be used in both of the described realms.

Interaction of the participant with the game may be achievable by remote control means which allows a player/gambler to sit or stand (even in a crowd) and manipulate the location of their markers on a display thus allowing for simultaneous game play by more than one player/gambler.

It is possible to allow the game event to be played by non-gamblers as well as gamblers at the same time while using the same event. As the accumulation or loss of points or valuable consideration can be remotely tallied, it is thus possible for non-gamblers and gamblers to participate in a new and enjoyable activity.

Conceivably, it is possible for the game method to be related to and integrated to the presentation of live broadcasts of events especially sporting events. A possible arrangement involves a set top box that is linked to a central control site via a communication arrangement (satellite uplink, cable return-path, telephone/modem line etc.). The set top box is under central control and superimposes over a received broadcast of an event, a plurality of zones associated with a chosen area of the event, such as for example the opening of a soccer goal. Odds are made available for the viewer to consider and if they choose, they can control the display to show a marker symbol and place one or more markers it in or over zone(s). The marker represents a wager the value of which is controlled by the participant.

The broadcast continues while the gambler/player watches with more than indifferent interest as they will have preselected the value of the marker and its position over or into their chosen zone(s) and know the reward that will accrue to them if they have chosen the zone correctly.

If the participant is correct as to their choice of zone, they are automatically rewarded with additional value redeemable or the increased value is made available for future participation.

In the above scenario, it is also possible for a remote observer to interact via their mobile phone or other suitable communication device that is capable of representing the barest of information. The device may allow the user to associate one or more zones with one or more tokens of value and for their wager to be communicated to a predetermined telephone number. A central controller means records the user, wager, and then debits or credits to a predetermined phone betting account or transfers value to stored value card located in the mobile phone.

The keypad of the remote access device can be provided with cursor display keys or be of the standard alphanumeric type, both are able to manipulate on the display the position of a marker and associate value thereto.

In more sophisticated embodiments of the game method, it is possible for the number of zones to vary according to the sophistication of the game player. For example, it could be possible for one remote participant to bet on an outcome using 8 zones, a further remote participant to bet on an outcome using 16 zones, and other participants on various other quantifies of zones.

Furthermore, it may be possible for the same sporting event to be used as an event generator for different zones for different participants although there are the same number of zones. The level or choice of zones to be used can be determined by the player/participant. As well as a variety of different random events in the same sporting contest ie, in a game of soccer the event may be the next goal or the next corner or the next foul, etc. The zones used could be additional to zones that already exist in the sporting contest. Preferably, the zones created for the game include the existing zones of the particular game that will be readily recognisable to game participants plus others which are completely new and which can be sub-zones of the existing zones.

Clearly, there are numerous delivery options for the game method described, options in fact that are not even in existence at this time but which will allow for the method to be used by participants located anywhere at any time.

Figure 5:
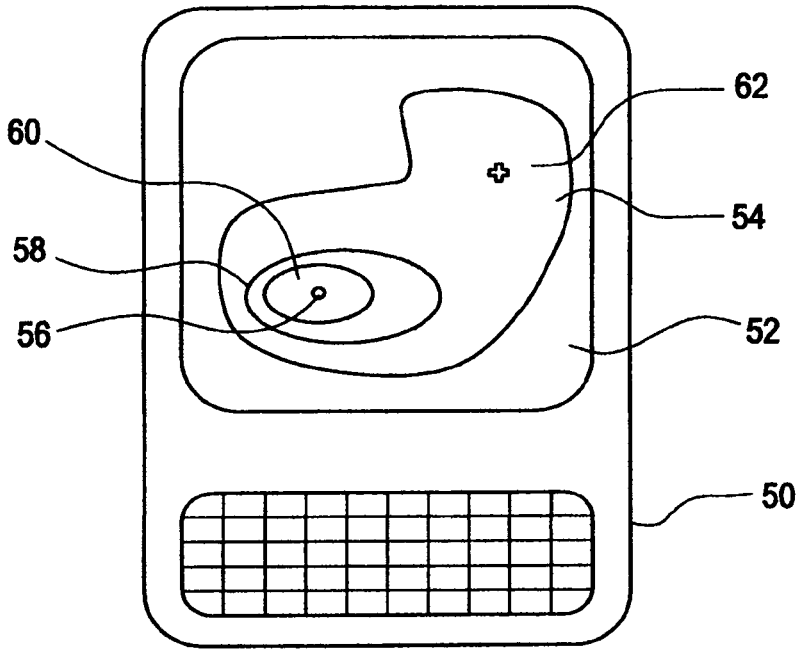
FIG. 5 depicts a hand held screen having zones superimposed over a variable image space.

FIG. 5 is but one example of the display possibilities for a game. A hand held device 50 which could be a mobile telephone will contain a monitor 52 upon which can be displayed various images. In this example, a plan view of a golf green is displayed 54 having a hole 56. The remote game participant is also shown three zones, the first being the area up to the outer boundary of the green itself 54. The next zone being delineated by line 58 and the next zone being delineated by line 60. Additional zones maybe used for example, grid like zones could be used within the abovementioned zones to provide more wagering possibilities.

The cursor 62 can be moved by the participant into any of the plurality of zones. Its location within a zone can be noted or it may be located on the boundary of two zones so the player increased their chance of choosing the correct zone but lowering the return for that success. The cursor may even be located over the hole, as that can also be a zone within the plurality of zones.

The choice being made by the participant is whether the golf ball to be hit by the next player will land in one of the zones on the green. If the ball does not land on the green, the house (betting authority) may win unless the player selected a zone outside the green or the or the wager made is held over for the next golf shot. There are of course, innumerable other options.

The house sets odds on the outcome of all possible events or selected events and the participant will have those odds displayed on a monitor viewable by the participant. The participant may designate a value for of one or more of their zone/s into or over which their marker is placed. The participant therefore knows what their possible return may be. A timer may be displayed and is used to indicate up to when the betting can be placed.

Clearly, the setting of the odds for each zone is not a trivial task but is similar to fixed odds setting for the outcome of sporting events. It is possible to ascribe fixed odds to a random event outcome resulting from say a live sporting contest since the house would in that circumstance accept the associated risk.

Thus, if an authority willing to take wagers on the outcome of an event is willing to ascribe odds for the event to occur, then it is possible for any event during a sporting contest to be available for wagering. In the context of the invention, the odds are associated with a zone or zones and related to the possible outcome of that event. For example the zone out of a plurality of zones in the opening of the goal through which a soccer ball will pass when the next goal is scored.

Clearly, it is important that the event chosen is an event the outcome of which is not predictable. Furthermore, it is important in a wagering environment that the odds of an event outcome occurring can be quantified by an odds setter. Most importantly, there must be no chance that the participants in the contest can unfairly influence the event outcome.

Thus, a random event generator can be used in some embodiments and is an event or a pseudo random event with an outcome which is random but not predictable. Random generators (typically number generators) are well known to those skilled in the computer art.

In a sporting event, the actual player or players and or a particular event can be chosen randomly by the controlling authority. This needs to be done independently and honestly, so that neither the participant or the player in the event will know exactly when the outcome will be determined. Of course, there has to be time for the participants to consider and lay their wagers. Thus, the event participant is less likely to purposely cause a particular event, thus further lessening a chance of event participant influence on the outcome.

Using live events, be they sporting or others, such as for example traffic movement or people walking down a street, will provide a vast array of events to choose from. In one respect the random observation of real life ensures that there is less chance of the event outcome being manipulated in anyway.

The ability to bet on various certain events in different activities will make the betting experience more interesting. It will also increase interest in the activity itself, thus making gamblers better understand that activity which they may have otherwise not have done.

Further there are also other forms of betting which could be adapted to the method and means of this invention, one of which is referred to as "spread betting".

Spread betting is a gambling method that differs from fixed odds gambling. For example, the returns on a fixed odds bet are always known, eg winning a $100.00 bet at odds of 8:1 always gives the gambler $800.00, but the gambler, if the bet is lost will loose their $100.00 bet.

Spread bets reward or penalise based on how much the person betting is right or wrong. For example, in a sporting contest Team A plays Team B and if the contest is decided on the basis of the team with the most goals, the authority offering the betting facilities will state a spread of say 2.7-3.0 goals in total being scored by the teams with a favoured position of Team 1 winning.

If the participant believes that the game will be low scoring they sell at the lower price of 2.7 with the selected stake of $100.00. Thus when the game is complete and there have been no goals scored, the participant wins to (2.7-0 (result)) times $100.00 equal to $270.00. If the result had been one goal total and Team A had won then the gambler wins (2.7-1) times $100.00 equal to $170.00. If the game total had been four goals, the gambler looses their $100.00 stake and owes (4-2.7) times $100.00 equal to $130.00.

The authority offering the ability to spread bets acts as a house and may adjust the spread at any time. Participants choose to play or not dependent on their skill in choosing to sell or buy and wager a stake.

It is in the interest of the house to keep the spread as narrow as possible in order to provide an attractive risk to potential participants. To encourage participation, the house may quote the spread in fractions of the normal game result, using units such as 2.3-2.6 goals so that a participant would win if three goals were scored.

It is also possible to provide spreads on events other than the result, for example, in soccer how many corners would be played during the game.

In an example only, of an adaptation of spread betting principles to the invention, a golf tournament and a particular par three hole can be used as the variable image space. It would be expected that most professional golfers would tee off and land their golf ball on the green dose to the hole. Odds available to encourage a wager by a participant could be related to a plurality of circumferential distances from the hole the golf ball may eventually rest. Thus, in one example, a hole in one would be paid out at 1000:1. If the golf ball lands and comes to rest within 1 metre of the hole the odds provided by the house are 100:1; for 2 metres 80:1, 3 metres 30:1, 4 metres 8:1; 5 metres 30:1, and 6 metres 50:1 and so forth.

This arrangement could be suitable for the game method previously described.

However, in a spread betting arrangement, the house offering betting facilities may quote a spread of 2.5 to 3.5 meters with the favourite being balls landing closer to the pin than the spread.

Thus, gamblers who believe that the ball will land and rest closer than 2.5 meters from the hole sell at 2.5 meters.

If the ball does land on the green and eventually rests at 1.5 metres from the hole, the player wins 2.5-1.5 equal one times their stake which if it were $100.00 is a reward of a further $100.00. However, if the gambler believed that the ball would land and rest within the zone 4.5 to 5 metres they sell and stake $100.00. If the ball then lands within the 1 to 1.5 metre zone the gambler loses (4.5-4.5) equals one times their stake which if it were $100.00 is a penalty of $100.00.

Clearly, there can be variations of the odds setting by varying the spread. There can also be variability in the size of the zones, the number of zones, the shape and designation of the zones and the manner in which the reward or penalty is calculated. Thus the principle of having odds from the result of a event based on zones located in respect of a live sporting or other event is maintained and used as such in this variant of the invention.

As described in some detail previously, it is possible when playing a game based on any of the above embodiments, for the participant to use an interactive means to designate their selections. In a television based environment used in conjunction with a cable TV delivery and data collection system, the participant could indicate their selection by a variety of means, eg touch-screen input, computer cursor control (remote from the participant's location) etc. In a playing board related environment, the game pieces used by a participant are, for example, articles and characters of certain professionals associated with the theme of the game.

It can also be possible for the authority providing the game/betting arrangement to receive instructions from multiple players via remote control units. The control unit may comprise a physical means such as a marker or even a written or marked card fed into a machine to record the marker location and wager. In a room full of participants each can participate could use a wireless remote control to mark and wager. The house thus receives the required information via a number of different means including a manual operation or remotely. 'SMART' cards which can contain monetary value to be used in the betting version of the game can be adapted to be read and used in the game. Thus, participants interact with the game and the variable image space via intermediary steps rather than by direct interaction with the variable image surface.

The selected marker for the participant is typically representative of monetary value but non-monetary participation is also possible. The marker may also be shaped, coloured or configured to have some significance to the theme of the game.

In the game examples described herein, the markers may be stackable, and reward for correct placement may comprise additional markers stacked upon the wagered markers. Further wagers can be made by stacking markers upon others to provide for higher valued piece placement prior to the next round of the game. Also stacks of markers can be split so as to spread the coverage of that type of marker over more zones prior to the next round of the game.

It is preferable, and provided for in the following game example which is substantially non-monetary in nature, for there to be a Mission Control participant. The theme of the game being described, is one of intrigue and danger associated with the operation of the Drug Enforcement Agency (DEA) and their quest to locate and arrest a drug baron of ill repute and ruthless character.

Game apparatus made available to the Mission Control participant may comprise a series of cards that can provide the random event outcome relating to a particular variable image space. In a computer-implemented arrangement, the computer can provide stored information suitable for each round or stage of the game that assists the Mission Control participant.

The game is controlled through the Mission Control participant who is coached in the setting of the scene for all other participants and non-participating onlookers. The playing surface (space) may be large enough to gather a crowd of people about the apparatus.

The initial description and instructions provided by the Mission Control participant could be as follows:

"Alright team, as you are well aware, organised drug trafficking is a global disease. We are the antibodies that must attack this infection that is ravaging our global community. You will be briefed on the cartels, their members, and their activities by accessing the "Global Cartels Dossier" available on your portion of the playing surface. Your job is to infiltrate these organisations using your specialist skills. This will be achievable by the thoughtful use of various tools at your disposal, and by the judicious placement of those tools where you feel they may gain the maximum benefit. Mission Control will keep track of your progress along the way, awarding or deducting points based on the success of your decisions.

"When your decisions are unsuccessful the DEA will not be able to gain any ground on these cartels, and points will be lost for unsuccessful utilisation of DEA resources. If an operative uses up all of their resources, the DEA will have no choice but to remove the operative from the field. Removal from the field is sometimes not an option as based on the task of the operative, unsuccessful use of operative resources may lead to capture and torture or execution at the hands of the cartel being investigated. In these circumstances, the DEA will do what it can to gain your freedom, however to ensure the future success of our missions, we will deny knowledge of your existence.

"However when your decisions are successful, the information you have gathered will be added to your dossiers, and you will be provided appropriate rewards in accordance with the difficulty of your decision. The operatives responsible will be awarded appropriate points based on the odds of being successful in covering a particular zone. In order to be successful in pinpointing and intercepting major drug transactions or related activities, your tasks will include collecting intelligence data on the movements of key figures within the cartels. Once a mission is completed, and the major drug shipment has been intercepted and the relevant criminals are apprehended, the operatives responsible will be promoted in rank. Good luck, and remember to be prudent with your resources.".

The game pieces in this example are characters that have been chosen to fit the theme of the game scenario. A preferable list of characters is as follows:

| | | | |
|---|---|---|---|
| Surveillance operative: | Name: | Muhoney, Peter | |
| | Rank: | Constable | |
| | Points: | 2000 | |
| | Resources: | Microphone | 5 points |
| | | Spy Camera | 25 points |
| | | Phone taps | 100 points |
| | | Body bugs | 1000 points |
| Undercover operative: | Name: | McCracken, Phil | |
| | Rank: | Constable | |
| | Points: | 2000 | |
| | Resources: | Petty buy cash | 5 points |
| | | Snitches | 25 points |
| | | Big purch cash | 100 points |
| | | Bodywire | 1000 points |
| Satellite surveillance specialist: | Name: | Skyhawk, Jimmy | |
| | Rank: | Technical Operator | |
| | Points: | 2000 | |
| | Resources: | Keyword phone scans | 5 points |
| | | Street cam satellite link | 25 points |
| | | Automobile GPS | 100 points |
| | | Infrared deal zoom | 1000 points |
| Money Laundering Investigator: | Name: | Pennywise, Isa | |
| | Rank: | Accountant | |
| | Points: | 2000 | |
| | Resources: | Tax return audits | 5 points |
| | | Asset valuations | 25 points |
| | | Legitimate enterprise audits | 100 points |
| | | Offshore account scans | 1000 points |

In this example, the participant known as the Mission Control character has direct involvement and relevance to the game and acts as a narrator and is therefore able to inform and guide all participants in the game. The Mission Control character would penalise and reward participants as required.

Mission Control will describe the relevance of the characters and their resources listed above, and if required describe how best they can be used during the game especially when the image space changes. Characters/pieces/markers are able to be placed on the playing space by each participant before the next event. Mission Control can also describe the way in which the event is going to be represented. In a sports related environment, Mission Control could be a television presenter explaining the sport, the zones and their predetermined odds or in a spread betting example, the favourite and the spread. In an interactive environment such as live sports broadcasting, gambling and betting can be incorporated by using the method of the invention described herein.

In the game example involving 36 or 38 fixed zones and a DEA scenario, as long as the event generator is truly random, ie that a number between 1 and 36 and "0" and/or "00" all have an equal chance of occurring, the way in which the event outcome is represented is a matter of theme and theatre.

A random number generator implemented in a physical embodiment such as for example a roulette-type wheel and ball could be used, or preferably in this example, a software program can be created to provide a random event outcome. There exists many ways in which a random outcome can be generated.

As described previously it may also be possible to have multiple random event outcomes and this can be facilitated by the use of multiple random number generators or multiple use of the same generator.

For example, the random event could be represented as the movement of a drug shipment over the world and the location in the world that the drug shipment lands thus becomes its location and the event outcome.

Thus in this example, the landing of a plane in a particular zone or a ship arriving at a port or a vehicle arriving in a state or province is the representation of the event and the outcome is the landing of the plane in a zone.

The skill of each participant is exercised in choosing which location upon the Earth they are to locate one or more of their characters and/or resources. The participant knows that if they disperse all their characters too thinly they lessen their chance of gaining a reward in the form of more resources. If they disperse their resources over as much of the Earth as they can, there are penalties and rewards, which need to be, carefully considered. Their penalty is at worst to lose all of their characters and/or resources and at best to lose a portion of the value of their characters and/or resources but to gain some resources. In this particular example, a participant will lose a character if the random event outcome is not related to the primary or secondary zone in which that character or resource is located.

In this example, more than one participant may choose to occupy the same zone and each participant faces the same penalty if the random event outcome is not related to the primary or secondary zone occupied.

Alternatively, a participant will benefit if the random event outcome is related to the primary or secondary zone occupied by one or more of the characters or resources of that participant occupying the zone.

In this example, the benefit is dependent on how the character was positioned on or associated with the zone that is identified by the random event outcome.

If the character was positioned on only one zone, then the benefit is a ratio of 35:1 times the value of the character or resource. In one example, that could mean 35 of those characters are provided to the participant from character resources held at Mission Control. The risk of receiving that return is slightly greater since the odds of the event occurring are 36:1 when a "0" event zone is incorporated into the game. The odds are 37:1 for a game incorporating an additional event zone such as for example "00". Therefore the 35:1 benefit is not a true reflection of the risk of being wrong and this indicates that there exists a bias in the reward risk arrangement against all participants. Indeed, a greater bias exists if there are two additional event possibilities (zones) such as "0" and "00".

The use of additional zones in the game may or may not be used. It is however, up to the discretion of the game creator to allocate odds and they may even provide an explanation for the existence of the bias into the scenario being played out by the participants.

The odds described in the above circumstance are not unlike those applicable in a game of Roulette in its use of numbers to identify zones and the use of outside zones and associated bets.

These aspects of the example though are not essential features of the invention.

If as described there are multiple random event outcomes associated with a single image space then there will be quite different odds to guide the reward and penalty aspects of the game. As one example, the reward for choosing to place two characters on two zones both of which are outcomes, should provide additional reward but the reward for a single character being placed on a winning zone will be less because it will be more likely to win because there are more random events.

It is possible for the game designer to use, as many zones as they think will be useful. Likewise, the zones can be variously shaped zones consequently more or less than four sides of a zone can meet at a common point. There can be as many secondary zones as thought useful. Furthermore, the benefits and penalties can be different to those described in the above example. It is also possible for colour variations, as opposed to traditional black and red to represent zones on a random generator device.

Therefore, in this example, if a character (playing piece or marker) is located along the extreme left or right-hand vertical line of the grid, it represents an association of that character with any of the three zones transverse of the grid of zones. For example, a character placed on the right-hand side of zone 3 is representative of an association with zones 1, 2 and 3). The benefit is 11:1 if the random event outcome is 1, 2 or 3.

If the character is located at the intersection of four zones (eg a character placed at the intersection of zones, 2, 3, 5 and 6), it is representative of an association of that character with zones 2, 3, 5 and 6. The benefit is 8:1 if the random event outcome is 2, 3, 5 or 6.

If, as is possible with the provision of "0" or "0" and "00" events, the character is placed at the intersection of "0", "00" and zone 2, it is representative of an association of the character with zones "0", "00", 1, 2 and 3. The benefit is 6:1 if the random event outcome is "0", "00", 1, 2 or 3.

It is also possible, to place a character at the top of a column of zones, eg above 1 or 2 or 3, or at the bottom of those same columns at 34, 35 and 36. The association is thus made between the 12 zones in respective columns and the character. The benefit is 2:1 if the random event outcome is any zone in the respective column.

It is also possible, though just as previous arrangements are not essential, to provide the ability to have an association of six zones. This is done by placing the character at the intersection of, for example, zones 28 and 30 but on the left-hand side of the playing space delineated by the zone grid. This represents an association of that character with zones 28, 29, 30, 31, 32 and 33. The benefit is 5:1 if the random event outcome is in zones 28, 29, 30, 31, 32 or 33.

The secondary zones are likewise playable in a similar manner and have a benefit ratio related to the single or combination zone play.

For example, the zones identified in FIG. 1 as "odd" and "even" geographic zones or "red" and "black" zones are playable. This is done by placing the character in one of those zones and representative of an association of the character with respective odd and even zone numbers or red and black zones. The benefit is 1:1 if the random event outcome is either an odd or an even, or, a red or black zone. If the event outcome is "0" or "00" the participant's penalty is the loss of the character. Zones on the wheel may also be coloured or associated with numbers on the playing surface. The association may vary from game to game or within the game and may have relevance to the theme (eg orange and green for a game theme entitled "Find Lucky the Leprechaun").

It is also possible to play the North and South Americas; European (etc.) Nations; and Russian Federation (etc.) Nations secondary zone which is representative of an association of the character with the zones 1-12, 13-24 and 25-36 respectively. The benefit is 2:1 if a random event outcome is any one of the respective 12 zones as described above.

A further similar arrangement is offered by the zone identified by 180° to 0° longitude west and 0° to 180° longitude east. These zones are representative of an association of the character located in either of those secondary zones with primary zones 1 to 18 and 19 to 36 respectively. The benefit is 1:1 if the random event outcome is one of the respective 18 zones of each type.

Clearly, the complexity of the game can be increased or decreased by having more or less combinations of associations between the placement of a character and the various zones.

Furthermore, as stated previously, the penalty and reward rules can be adjusted so as to bias towards the participants or the game controller (in this particular example, Mission Control), or be totally even-handed in that regard.

The ability to adjust these criteria make it possible for a game designer to tailor the game scenario, difficulty and reward scheme to suit different types of participants.

For example, small children can be provided a lesser number of zones (primary and secondary) than used in the example. Simpler odds for calculating rewards and no bias or a positive bias in the odds towards the participants can also be incorporated into the game for young participants. Of course, a simplified scenario or series of scenarios of interest to children will improve its acceptance by children. The game scenario may even be educational and the graphics can be made to be colourful and entertaining.

In a further example, adults legally allowed to wager, can be presented scenarios which make the game entertaining while they concurrently use their skill to maximise return for the risk they take with their own money. In this circumstance, the game designer can vary the penalty and reward rules to favour the game controller that could for example be the house in a casino. In the case of a charity the game could be run for entertainment as well as to raise revenue. The bias could also favour the players in a fun or minimum participant risk environment.

The apparatus and methods described herein are therefore the basis for an infinite variety of scenarios and the skill of the players can be pitted against positive or negative biases built into the game.

For the sake of the example being described, let us say that the outcome of the random event is zone 6.

The random event 6 was depicted as an aircraft flying over the surface of the Earth which lands on zone 6 thus indicating the random event outcome produced by the random event generator.

Each participant having a character associated in some way with zone 6 is rewarded. In this example, each character not associated with zone 6 is forfeited to Mission Control or its nemesis which, according to a relevant scenario, could be the Supreme Drug Baron. Such options are under the control and wishes of the game designer.

Figure 2:
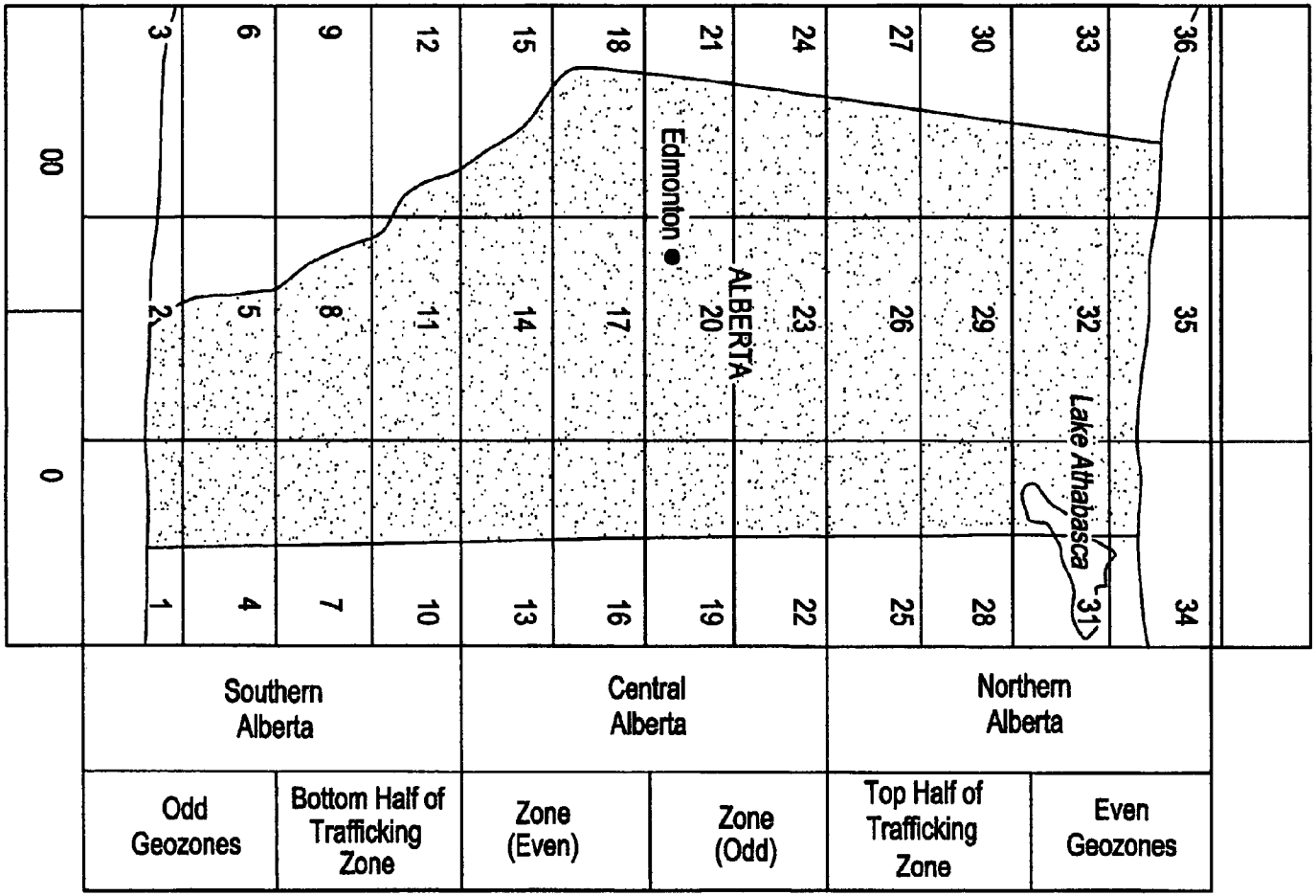
FIG. 2 depicts screen 2 of a preferred two-dimensional image space.

FIG. 2 depicts the province of Alberta, Canada, and surrounding provinces, which lay within zone 6 of the first image space and which, are now overlaid with a 36 zone grid.

Mission Control explains to all the participants that an aircraft carrying a drug cache has landed somewhere in the depicted region (any one of the 36 zones of the second image space).

Each participant then uses their skill and luck to position one or more of their remaining characters and/or resources so as to be associated with one or more of the zones 1 to 36, "0" and/or "00".

Each participant has finite resources, in the form of characters and associated resources. In some instances at this stage of the game; the participant will have more than they began with as a result of the balance of the rewards and penalties that they experienced on the previous round of the game. In other cases, they will have the same number of characters and resources possibly because of the balance of the reward and penalty experienced in the previous round. Or because they declined to participate since participation in each round is, in this example, not mandatory. In yet other cases, the participant will have fewer resources than they began with due to the balance of rewards and penalties they experienced on the previous round of the game.

It will be noted that the description of the secondary zones has changed in FIG. 2 in accord with the subject matter of the second image space (eg Top Half of Trafficking Zone, Northern Alberta, etc.).

Again the descriptions provided for the secondary zones may be illustrative rather than geographically accurate, as will be described by Mission Control. It may be allowable in the game rules which will accompany the game, for certain secondary zones (defined by their location) regardless of their description to be associated with certain of the primary zones.

As an example of a representation of a random event, the making of a phone call to confirm receipt of the cache of drugs is being made from somewhere in the second image space.

By way of example, the random event outcome is zone 20 in which is displayed a shady character making a telephone call. The radio waves emitted by the cellular telephone call used by that character are shown spreading to the whole of the playing surface.

Again, the participants who have located characters or resources that are associated with zone 20 are rewarded, and participants who placed their resources and characters in zones not associated with zone 20 are penalised. Then the image space changes again to that which is depicted as an example in FIG. 3.

Figure 3:
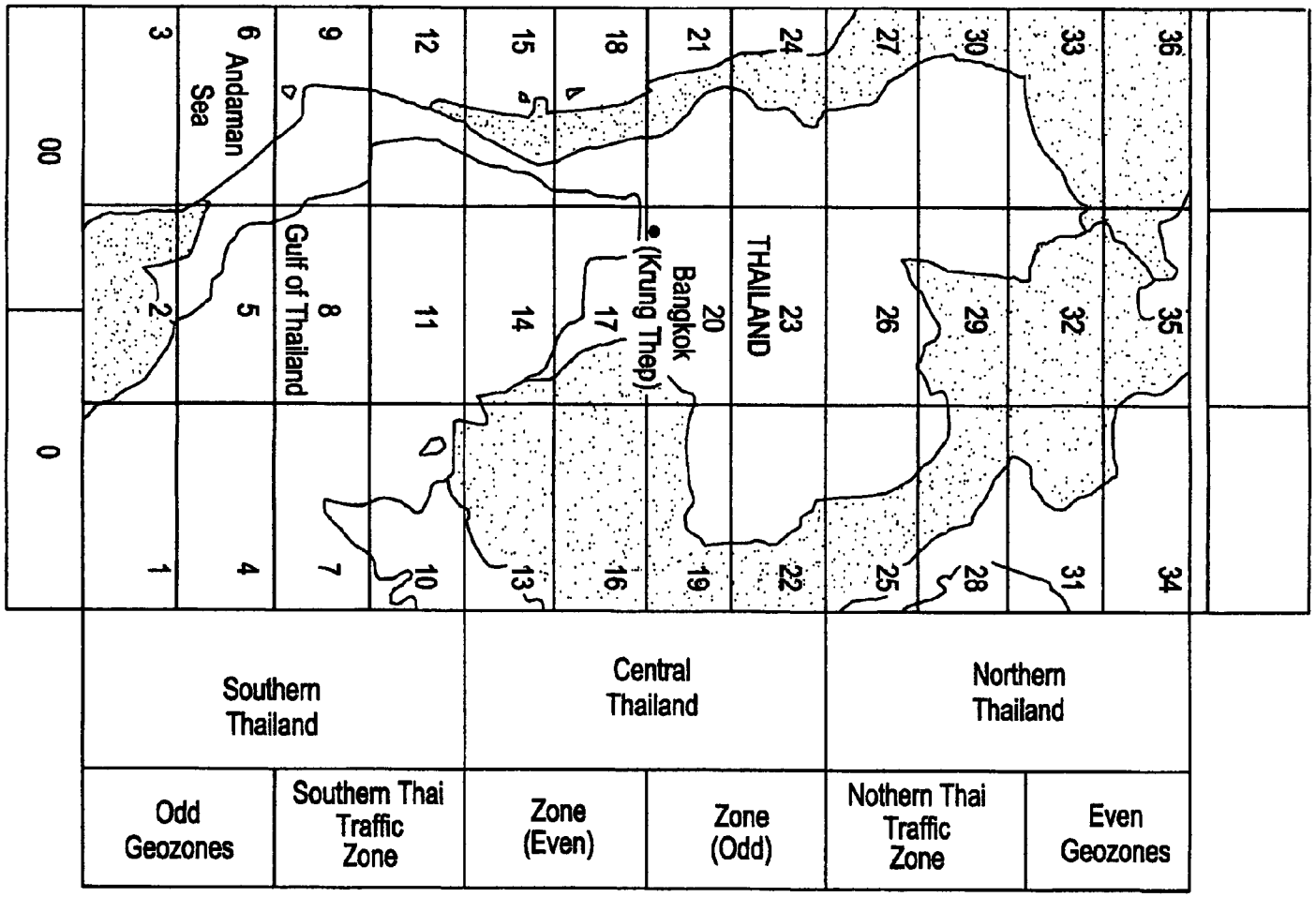
FIG. 3 depicts screen 3 of a preferred two-dimensional image space.

FIG. 3 depicts the country of Thailand and its surrounds. Mission Control informs each participant that the cellular telephone call has been received somewhere in the new image space which again has been overlaid with 36 zones and which also has associated secondary zones. It will be clear that the scenario creator will need to create not only a serial array of successively played out scenarios and associated image spaces, but also may consider adding complexity by providing a separate scenario for each possible random event outcome. Such an arrangement would translate into a scenario for each of the 1 to 37 or 38 zones. Also combinations of scenarios could be predetermined and used, depending for example on whether the prior random event outcome zone is an odd or even zone or some other such criteria.

It is also possible for the game to have further levels of scenario complexity, since the character(s) used by participants located in or associated with a zone can affect the next scenario and/or image space. For example, a character such as a Satellite Surveillance Specialist if used correctly by a participant (for example located solely in the random event outcome zone) may determine that the next scenario will be associated with that character. For example a message of congratulations from Mission Control and a bonus reward over and above the expected reward of 35:1.

It may also be possible for the participant to partition the value of a character or resource. Say for example, a Satellite Surveillance Specialist is worth 2000 points. Thus, it may be possible to halve or quarter the character into 1000 or 500 point lots. This could easily be incorporated by an appropriate storyline and circumstance which provides for the splitting of available resources. Again, it is up to the game designer to determine how this type of arrangement could or should be used. The image space, in this example, is provided on a computer screen. A computer screen can be arranged to display not only the changing image space but also to provide descriptions of the secondary zones, draws the coloured grid lines and provides zone numbering. In fact this embodiment offers a great deal of flexibility, since the image space can even be made to look three-dimensional thereby adding a further level of interest and entertainment.

It is conceivable though, that the image space could actually be a screen set into a large enough table so that multiple participants can simultaneously play the game. In this case, all the primary and secondary zones can be displayed on the screen in easy to read format. Flat monitor screens are now available and their size is ever increasing which thus allows for the possibility of locating a screen on a wall. It could also be projected on to a screen for a theatre-like presentation to room of participants.

Figure 4:
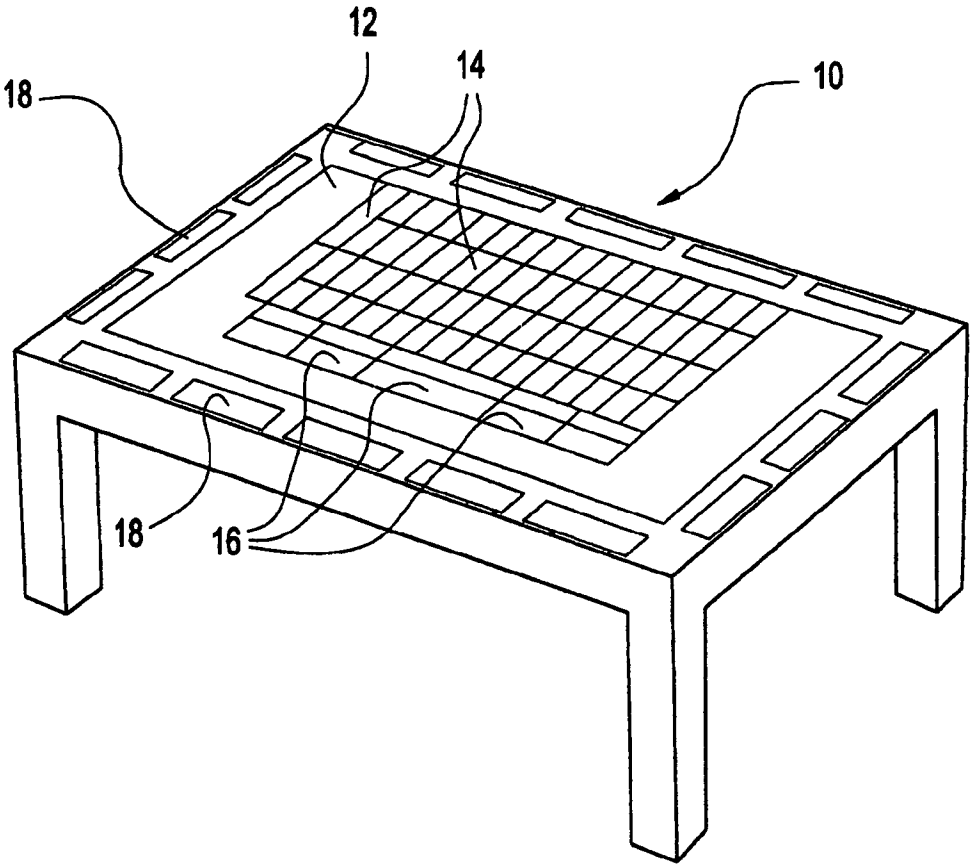
FIG. 4 depicts a preferred physical arrangement of a game playing apparatus according to one aspect of the invention.

FIG. 4 is but one embodiment of an apparatus for playing the game described herein. A table 10 is fitted with a flat panel screen shown in the boundary 12 on which is displayed a primary zone 14 comprising 36 zones (numbers not shown) and various secondary zones in the depicted secondary zone areas 16. The remainder of the screen area can be used for game related or game unrelated images (static or moving).

Each participant (including in this example the Mission Controller) may occupy one of the locations 18 about the periphery of the table. Each location provides a control console upon which game rules can be displayed, scenario briefs, player characters and resources, value accumulation counters, etc. Character and resource manipulation controls are made available so that characters and resources can be moved onto and over the primary and secondary zones. An event can be represented in many ways. In this example, the random event image is displayed as it occurs over the primary zone and eventually provides an outcome by highlighting in some way the zone which is representative of the outcome. It will be noted that zone numbers have not be mentioned, since it is possible to represent the zones in many ways as the random event.

Computer processing to provide the functions required to perform the method of the invention may be physically located in the table framework. However, such resources could just as easily be located remote of the playing surface or screen.

Indeed, not all the participants need be located about the same table. Remotely located participants in a Multi Player System can also be involved in the same game. Communication arrangements are readily available to provide those remote participants a control console and a screen, which displays the same image/s as that provided to the screen 12 of the table 10.

Adjacent participants may play with physical characters and resources or manipulate electronic versions thereof which may then be recorded and maintained by the games processor which controls most of the previously described aspects of the game.

It is also possible that the game image space will be projected into a three-dimensional form such as for example a holographic or virtual reality representation of a three-dimensional space. Interaction by the participants in the three-dimensional space by placement of their characters and/or resources is also conceivable. It matters not as to how many dimensions the image space is provided as long as the elements described (in whatever embodiment) can interact with each other in the required manner for the performance of the game. It may also be possible to arrange for participants to interact with the game and other participants although they are remote from one another by using a network of computers.

In yet a further adaptation of an aspect of the game method using the principles of lotto games can be used to provide another betting arrangement. Whereas, the random event in keno or lotto is the selection of say six or more numbered balls from 48 or more balls, the random event in the new game can be related to one or more sporting events and in particular to one or more predetermined types of events in those sporting event. Such as for example, when a grid of say 12 numbered zones is associated with the area between the goals of a football contest. It may be the number of the zone that the football passes through for the first goal in six separate football games that determines the six numbers to be chosen by the participant. In one arrangement there can be repeated zone numbers. Clearly, if the same zone occurs in the sequence and there need to be six different number, then the ball passes through later when a further goal zone (as long as it is different) can be used.

The betting participant(s) who correctly predict the six zones can, as in lotto, take a predetermined proportion of the funds bet by all participants. Also, not unlike keno and lotto there may be proportions of the pooled funds available for participants who predict less than the six zones.

A further means for creating a random event is to associate a grid with the sporting contest playing arena and based on the positioning of players within zones at unpredictable times during the game. Participants win or lose depending on whether they can predict which zones have two or more players within them at the relevant times. Such a selection process could be ongoing during the match and for example at random times the selections made by participants are compared with the actual game situation.

So that there can be predetermined odds associated with the event, the authority providing the betting facilities may provide a minimum dividend to participants who correctly predict zones regardless of the proportion of a pool of bet funds that are provided to those participants. In fact, such an arrangement can be used to provide fixed odds as well as a totalizator function. The pay-out for a regular event could be based on fixed odds available at predetermined intervals not unlike a keno arrangement.

The sporting event may not necessarily be a single sporting contest, it may be an artificial event, such as for example, a selected number of virtual bicycle riders interacting over a computer network such as the Internet. Such an arrangement could be considered as a computer controlled or generated sporting event, the outcome of which is used in the game method described.

Clearly, the association of zones will be done in accordance with a characteristic of the sporting or other event chosen. For example in a soccer game the zones could be arranged over the face of the rectangular goal face, in a golf game they could be arranged over a green on a par three hole, etc.

The game can be adapted, at the discretion of the game creator, to be used to educate, showcase the art of artists, advertise, and/or entertain.

For example, in between sessions of the game the image space can be used to advertise or provide infotainment, the characters or scenarios may contain advertising material or the scenario itself may be created with a particular advertising-like feature.

The game may be arranged to mimic different sports events. For example, each sport in the Olympics could be depicted, and the random event of the game could for example be the difference between an athlete's best and worst achievements over the last three years. Thus, each zone could represent a number of levels above, below and in between the range of their achievements. Thus so that in an unpredictable way, an athlete's performance is associated with a zone and participants are rewarded or penalised according to their prediction of the event outcome as has been associated with a particular zone. Clearly a particular team sport could also be depicted and adapted with appropriate choices of scenarios and use of a random element such as the fall of a ball within a sports arena or like event.

In an educative game, the participants will have a level of knowledge and an aim of the game will be to increase their knowledge in a particular area. The game may use a certain event to provide a number of zones that represent certain options relating to the event. The answer provided could then become a route through a repair process of a technical piece of equipment, etc.

Clearly, the scenarios of such a game will need to be well thought out and various dependencies anticipated. However, the opportunity to create for a number of participants an entertaining and learning environment can be very beneficial.

It will be appreciated by those skilled in the art, that the invention is not restricted in its use to the particular application described, and neither is the present invention restricted in its preferred embodiment with regard to the particular elements and/or features described or depicted herein. It will be appreciated that various modifications can be made without departing from the principles of the invention, therefore the invention should be understood to include all such modifications within its scope. In this specification the use of the term comprises implies the meaning of consists.

The claims defining the invention are as follows:

1. A data conveyance apparatus for playing a game using an environment either real or created which itself is not a game of chance in which an event occurs, the apparatus comprising:

a means to delineate zones with delineation indicators wherein said zones correspond to zones in said real or created environment or in a visual representation thereof geometrically and/or spatially such that said event may occur geometrically and/or spatially within or under a zone or on a delineation indicator and thus associated with one or more zones geometrically and/or spatially to thereby create a game of chance that associates an event outcome with a zone or zones; when a plurality of markers, each marker having a predetermined value measured in a predetermined number of value units, for a game participant to associate with said one or more delineated zones; and a means to present the zone that said event becomes associated with and/or a visual representation of said real or created environment where said event occurs within or under a zone or on a delineation indicator, such that a game participant is rewarded by the addition of a marker/s of value or value to the one or more markers which a participant has associated with the zone that the event becomes associated with, and a game participant is penalized by the removal of the said one or more markers or the removal of value from the said one or more markers that a participant did not associate with a zone that the event becomes associated with.

2. A game playing apparatus according to claim 1 wherein said reward is provided in accordance with odds related to the event being associated with a zone or zones.

3. A game playing apparatus acoording to claim 2 wherein said event is scheduled to occur at regular intervals and said rewards are provided after an event.

4. A game playing apparatus according to claim 1 wherein the value of the markers that are risked by said one or more participants are pooled and a reward to a participant comprises a predetermined proportion of said pooled value.

5. A game playing apparatus according to claim 1 wherein said reward is provided in accordance with spread betting odds related to said event occurring in a zone.

6. A game playing apparatus according to claim 1 wherein said real or created environment changes after said event and said change of said environment is related to the outcome of said event and presents said participants a new relevance to one or more of said zones which is further related to the outcome of the same or a different event wherein there exist predetermined odds of the result of said event being associated with a zone or zones.

7. A game playing apparatus according to claim 1 wherein said display means presents a two-dimensional image or a multi-dimensional space having a plurality of zones associated therewith wherein each zone is presented to game participants in two-dimenional or multi-dimensional form.

8. A game playing apparatus according to claim 1 wherein said means to delineate zones creates one or more external zones the existence of which are associated with said real or created environment and which may be associated with a participant's marker and which have predetermined odds of an event occurring within a said external zone.

9. A game playing apparatus according to claim 1 wherein there are a plurality of events associated with a real or created environment, thereby allowing a plurality of event outcomes within a plurality of zones to occur.

10. A game apparatus according to claim 1 wherein said real environment is a live environment.

11. A game playing apparatus according to claim 10 wherein said display means presents a display representative of a live environment.

12. A game playing apparatus according to claim 1 wherein the event outcome is the result of a predetermined action occurring in said real environment.

13. A game playing apparatus according to claim 1 wherein the event outcome is representative of the result of a predetermined action occurring in said real environment.

14. A game playing apparatus according to claim 10 wherein said live environment is a live sporting contest.

15. A game playing apparatus according to claim 14 wherein said event outcome is the result of a predetermined action occurring during live sporting contest.

16. A game playing apparatus according to claim 1 further comprising a marker placement information receiving means and an intermediate marker placement information means wherein the association of a marker with one or more of said zones is achieved through said intermediate means that receives from said participant the pre-selected intention of the participant and associates their marker and its value with their pre-selected zone or zones.

17. A game playing apparatus according to claim 16 wherein said intermediate means is a portable device having communications means for communicating a marker association to said game playing apparatus.

18. A game playing apparatus according to claim 1 further comprising means to set odds of an event occurring in any one or more of said zones.

19. A method for creating and playing a game comprises the steps of:

a) creating or observing an environment which itself is not a game of chance in which an event occurs;

b) a delineating means indicating a plurality of zones wherein said zones correspond geometrically and/or spatially to zones in said real or created environment or a visual representation thereof such that said event may occur within or under a zone or on a delineation indicator and thus associated with one or more zones to thereby create a game of chance that associates an event outcome with a zone or zones;

c) a data conveyance means displaying to one or more participants the zone that said event becomes associated with and/or a visual representation thereof where said event occurs within or under a zone or on a delineation indicator and thus with one or more zones;

d) a game participant associating with one or more of said delineated zones in said display a marker or markers having a predetermined value measured in a predetermined number of value units;

e) an event outcome being associated geometrically and/or spatially with a zone; such that a game participant is rewarded by the addition of a marker/s or value to the one or more markers that are associated with the zone that the event becomes geometrically and/or spatially associated with; and a game participant being penalized by the removal of the said one or more markers or the removal of value from the one or more markers not associated with the zone that the event becomes geometrically and/or spatially associated with.

20. A method for playing a game according to claim 19 comprising the further step of:

f) wherein said real or created environment changes after said event and said change of said environment is related to the outcome of said event and presents said participants a new relevance to one or more of said zones which Is further related to the outcome of the same or a different event wherein there exist predetermined odds of the result of said event being associated geometrically and/or spatially with a zone or zones.

* * * * *